US005975861A

United States Patent [19]

Shin et al.

[11] Patent Number: 5,975,861

[45] Date of Patent: Nov. 2, 1999

[54] PUMPING ASSEMBLY FOR USE IN VENTILATED FOOTWEAR

[76] Inventors: Bongseop Shin, Samsung Apt. 7-905,777, Mangmi 1 dong, Sooyong-ku; Donggeon Kim, Daeyon samik Apt. 102-108, 1808, Daeyon 3 dong, Nam-ku; Seonjoon Kim, Samhae Daelim Apt. 107-1705, 1199-11, Banyo 1 dong, Haeundae-ku; Seongog Cho, 653-12, Kuseo 2 dong, Kumjung-ku, all of Pusan; Kwangseog Park, Ssangyong A-jin Green Apt. 309-802, 773-13, Sangan-ri, Nongso-eup, Woolju-ku, Woolsan-si, Kyong-nam, all of Rep. of Korea

[21] Appl. No.: 08/890,143

[22] Filed: Jul. 9, 1997

[30] Foreign Application Priority Data

Jan. 6, 1997 [KR] Rep. of Korea ..... 97-167

[51] Int. Cl.[6] ..... F04B 53/00

[52] U.S. Cl. ..... 417/234; 417/229; 417/472; 36/29; 36/35 B; 36/3 B

[58] Field of Search ..... 417/229, 234, 417/472; 36/3 B, 29, 35 B

[56] References Cited

U.S. PATENT DOCUMENTS

| | | | |
|---|---|---|---|
| 1,194,152 | 8/1916 | Douglas | 36/3 B |
| 2,157,912 | 5/1939 | Nabokin | 36/37 |
| 3,331,146 | 7/1967 | Karras | 36/3 |
| 4,918,838 | 4/1990 | Chang | 36/28 |
| 5,010,661 | 4/1991 | Chu | 36/3 B |
| 5,068,981 | 12/1991 | Jung | 36/3 B |
| 5,138,775 | 8/1992 | Chu | 36/3 B |
| 5,333,397 | 8/1994 | Hausch | 36/3 B |
| 5,341,581 | 8/1994 | Huang | 36/3 B |
| 5,477,626 | 12/1995 | Kwon | 36/3 B |
| 5,697,170 | 12/1997 | Murrell et al. | 36/3 B |
| 5,697,171 | 12/1997 | Phillips | 36/3 B |
| 5,826,349 | 10/1998 | Goss | 36/3 R |

*Primary Examiner*—Timothy S. Thorpe
*Assistant Examiner*—Ehud Gartenberg
*Attorney, Agent, or Firm*—Notaro & Michalos P.C.

[57] ABSTRACT

A pumping assembly for use in ventilating footwear includes a supporting plate having a first protrusion which is formed in a center portion of an upper surface thereof; front and rear check valves which are respectively formed forwardly and rearwardly the first protrusion portion; an exhaust pipe which is connected to the front check valve; an intake pipe which is connected to the rear check valve; a spring which has a lower end inserted into the first protrusion on the supporting plate; a curve-shaped hard plate having a second protrusion portion which is formed in a center portion of a bottom surface thereof and is inserted into an upper end of the spring; and an elastic cover which has elasticity and tensibility and covers the hard plate. The cover is bonded to the hard plate, whereby the hard plate descends in such a manner that maximum volume variation within the elastic cover can occur; when the upper rear portion of a foot pressurizes the hard plate and the elastic cover is pressed down.

1 Claim, 3 Drawing Sheets

PUMPING ASSEMBLY FOR USE IN VENTILATED FOOTWEAR

BACKGROUND OF THE INVENTION

1. Field of the Invention

The present invention relates to a pumping assembly for use in ventilating footwear which is inserted into an inner portion of the upper rear portion of a footwear sole and forcibly inspires fresh air from outside toward the inner portion of the footwear, during walking, thereby preventing sweat and moisture within the footwear as well as a nasty smell caused by to the sweat and moisture. This also prevents skin disease such as athlete's foot from occurring, while absorbing external impact and increasing comfort due to a cushion action thereof. In particular, the present invention relates to a pumping assembly for use in ventilating footwear which has an air pumping function with a hard plate which is inserted into of an elastic cover.

2. Discussion of the Prior Art

Generally, existing footwear can not discharge sweat and moisture formed in the footwear to the outside, since air flow into and out of the footwear does not fully occur, so that the footwear is always humid and is well-known as a hotbed of various bacteria, thus causing a bad smell, athlete's foot and so on. As is known, this problem in footwear is more serious during the summer.

Even though footwear has been designed to prevent the aforesaid inconveniences, there still exists a disadvantage in that very little of air flows into/from the footwear, during walking.

In more detail, in the conventional ventilating footwear, a material of an upper portion of a pumping assembly is made of a soft material and that of a side portion thereof is thick, or made of a hard material. Therefore, during walking; since most pressure onto the footwear is delivered only on the soft material positioned on the center portion of an upper surface of the pumping assembly, the volume variation within the pumping assembly is small.

Accordingly, since the volume variation within the pumping assembly of the conventional ventilating footwear according to the pressure applied to the pumping assembly, during walking, is small, there is a problem in that the amount of air which flows into/from the footwear is accordingly small.

SUMMARY OF THE INVENTION

An object of the present invention is to provide a pumping assembly for use in ventilating footwear which is capable of obtaining maximum volume variation efficiency, by application of a hard plate, to the extent that an amount of intake air into the footwear increases 5 to 10 times that of conventional ventilating footwear.

To achieve one or more objects of the present invention, there is provided a pumping assembly for use in ventilating footwear including a supporting plate having a first protrusion portion which is formed in a center portion of an upper surface thereof; front and rear check valves which are respectively formed forward and backward from the first protrusion portion; an exhaust pipe which is connected to the front check valve; an intake pipe which is connected to the rear check valve; a spring which has a lower end inserted into the first protrusion portion on the supporting plate; a curve-shaped hard plate having a second protrusion portion which is formed in a center portion of a bottom surface thereof and is inserted into an upper end of the spring; and an elastic cover which has elasticity and tensibility and is covered over the hard plate, thereby being melted or bonded to the hard plate, whereby the hard plate descends in such a manner that maximum volume variation within the elastic cover occurs, when the upper rear portion of the foot pressurizes the hard plate and the elastic cover is pressed.

DETAILED DESCRIPTION OF THE PREFERRED EMBODIMENTS

With reference to the attached drawings, a pumping assembly for use in ventilating footwear according to the prevent invention will be explained in detail.

Figure 1:
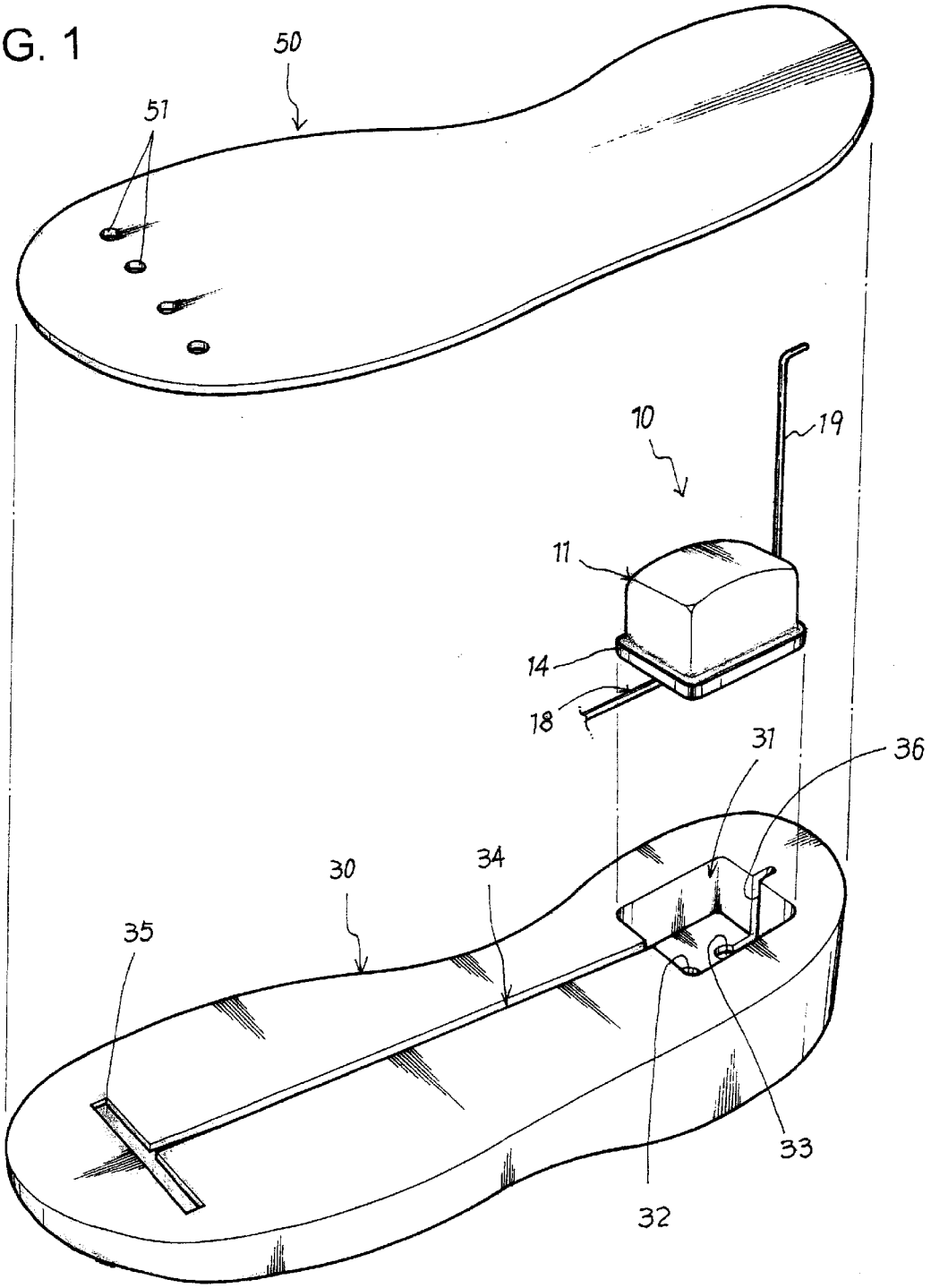
FIG. 1 is an exploded perspective view illustrating a use state of a pumping assembly in ventilating footwear according to the present invention.
Figure 2:
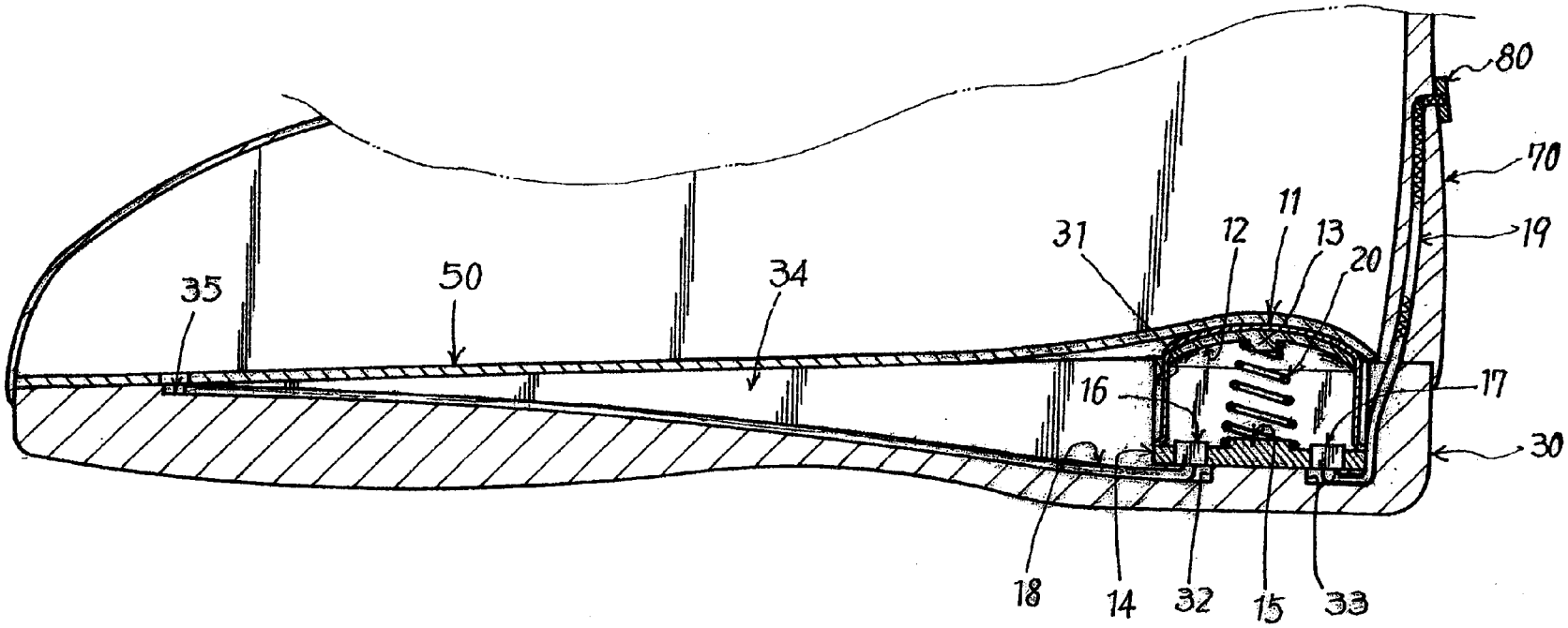
FIG. 2 is a sectional view illustrating a use state of a pumping assembly in ventilating footwear according to the present invention.
Figure 3:
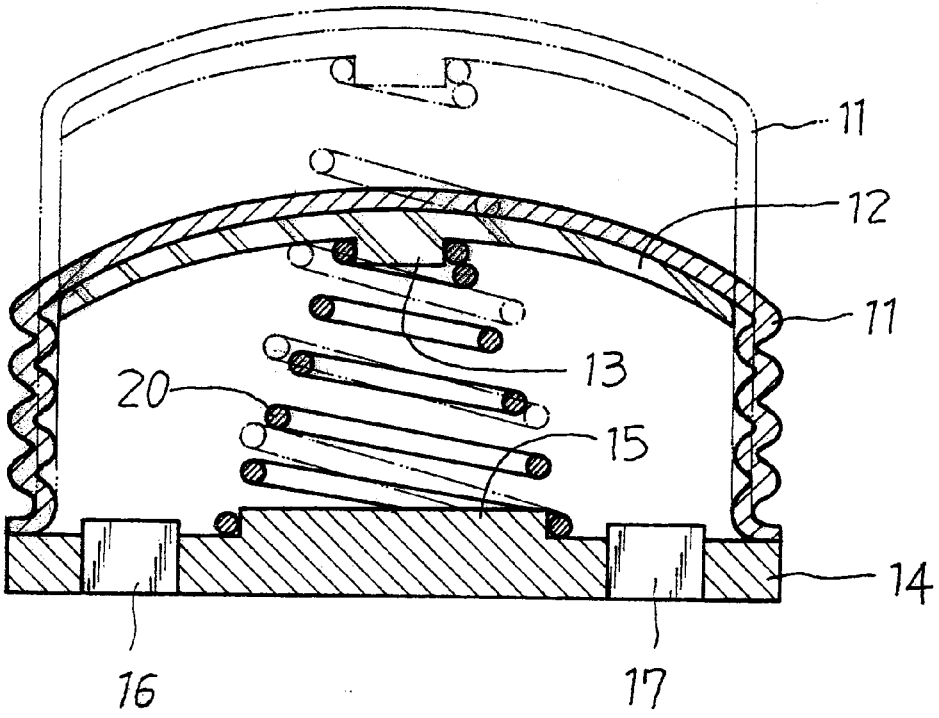
FIG. 3 is a partial view illustrating an operation state of a pumping assembly in ventilating footwear according to the present invention.

Referring to FIGS. 1 to 3 which show the use and operation states of a pumping assembly 10 for use in ventilating footwear according to the present invention, in construction, a first protrusion portion 15 is formed in a center portion of an upper surface of a supporting plate 14. Front and rear check valves 16 and 17 are respectively formed forwardly and rearwardly of the first protrusion portion 15. An exhaust pipe 18 is connected to the front check valve 16, and an intake pipe 19 is connected to the rear check valve 17. A spring 20 is inserted into the first protrusion portion 15 on the supporting plate 14 at the lower end thereof. A second protrusion portion 13 is formed in a center portion of a bottom surface of a dome-shaped hard plate 12 and is inserted into an upper end of the spring 20. An elastic cover 11, which has elasticity and tensibility, covers the hard plate 12, and is melted or bonded to the hard plate 12, whereby the hard plate 12 descends in such a manner that maximum volume variation within the elastic cover 11 can be generated, when the upper rear portion of foot pressurizes the hard plate 12 and the elastic cover 11 is pressed down.

The pumping assembly 10 according to the present invention may be applied to all typical footwear, and particularly, it is assumed that the pumping assembly 10 is installed in the footwear in which soles as shown in FIGS. 1 and 2 are used.

A space 31 is formed in the upper rear portion of a typical sole 30, and front and back slots 32 and 33 are formed in the bottom portion of the space 31. A vertical slot 36 is connected to the back slot 33, and an inclined passage 34, which is formed in a length direction, is connected to the front slot 32. A slot 35, which is perpendicular to the inclined passage 34, is connected across the front end of the inclined passage 34. The pumping assembly 10 constructed according to the present invention is mounted within the space 31 of the sole 30, and the upper end of the intake pipe 19 is fixed by a fixing protrusion 80 at the top side of the upper rear portion of an upper leather of footwear 70.

When a person wearing the footwear into which the pumping assembly is inserted, is walking, the bottom surface of the sole 30 of the footwear is in contact with the ground, and the hard plate 12 of the pumping assembly 10 and the elastic cover 11 which surrounds the hard plate 12 is pressurized by the weight of a step.

As the hard plate 12 and the upper portion of the elastic cover 11 descend, the spring 20 is contracted as far as the hard plate 12 descends.

As the hard plate 12 descends, the volume inside elastic cover 11 decreases and the inner air corresponding to the decrement amount of the volume, within the elastic cover 11, is discharged within the footwear through the front check valve 16, the exhaust pipe 18 and the slot 35.

Next, when the sole 30 of the footwear raised off the ground, the hard plate 12 is returned to the original position, due to the restoring force of the spring 20, and the elastic cover 11 also takes its original shape.

Accordingly, with a restoring force of the pumping assembly 10, fresh air outside the footwear flows into the elastic cover 11 through the intake pipe 19 and the rear check valve 17. The amount of air flowing in is proportional to that discharged previously.

Preferably, the spring 20 has a cone shape, and the elastic cover 11 covering the spring 20 has a constant thickness and is excellent in elasticity and tensibility. Therefore, the elastic cover 11 can be contracted and restored, while having no influence on the function of the spring 20. As a result, the spring 20 can be completely pressed, without receiving any interference from the elastic cover 11, when the pressure is applied from top.

Furthermore, in the pumping assembly 10 according to the present invention, the greater the load applied the larger an amount of air pumped. A piston action strength of an air cylinder, which corresponds to load of a person who puts on the footwear having the pumping assembly 10, is divided into 20 Kg, 30 Kg, 40 Kg, 50 Kg, 60 Kg, 70 Kg, and 80 Kg, respectively. After pumping tests for each load are executed over 300 times or more, it can be appreciated that the amount of air pumped one time in the ventilating footwear having the pumping assembly according to the present invention increases as much as 5 to 10 times, compared with that of conventional ventilating footwear.

Moreover, since the front and-rear check valves are formed in the bottom surface of the supporting plate and the exhaust pipe and the intake pipe are protected by the supporting plate, the complete form of the pumping assembly during the pumping can be maintained, without any distortion. Further, the structure of the pumping assembly 10 has no influence over component parts associated therewith, exhibiting the excellent pumping function.

During walking, through the repeating pumping operation, a large amount of flesh air from the exterior of the footwear flows into the interior of the footwear, and moisture and sweat existing within the footwear are fully discharged to the outside. Therefore, fresh air is always within the footwear, so it can more effectively remove skin disease such as athlete's foot as well as a bad smell away from the feet, when compared with the conventional footwear. Furthermore, since the elasticity of the pumping assembly functions as an excellent cushion, during walking, it can buffer the impact applied to the upper rear portion of foot. As a result, wearing the footwear feels good and fatigue is reduced.

The hard plate in the preferred embodiment of the present invention may be comprised of plastic, metal, wood, or resin, the elastic cover may have a cylindrical shape, and the supporting plate may have a circular plate shape.

What is claimed is:

1. A pumping assembly for use in ventilating footwear, comprising:

a supporting plate having a first protrusion portion which is in a center portion of an upper surface of the supporting plate;

front and rear check valves in the supporting plate and respectively forward and backward of the first protrusion portion;

an exhaust pipe connected to the front check valve for exhausting air from the front check valve into the footwear;

an intake pipe connected to the rear check valve for receiving air from the rear check valve and from outside the footwear;

a conical spring having a lower large end engaged around the first protrusion portion on the supporting plate;

a dome-shaped hard plate having a second protrusion portion which is in a center portion of a bottom surface of the hard plate, the spring having an upper small end engaged around the second protrusion portion; and an elastic cover which has elasticity and tensibility and covers the hard plate, the cover being fixed to the hard plate, the hard plate descending to reduce a volume within the elastic cover when the hard plate is pressed down by a foot of a person wearing the footwear for exhausting air through the front check valve, the spring returning the cover to an upward position to increase the volume in the cover for receiving air through the rear check valve.

* * * * *